US010973328B1

(12) United States Patent
Tham

(10) Patent No.: US 10,973,328 B1
(45) Date of Patent: Apr. 13, 2021

(54) FURNITURE CONSTRUCTION AND PACKING METHOD

(71) Applicant: Noble House Home Furnishings, LLC, Chatsworth, CA (US)

(72) Inventor: Siew Kin Tham, Chatsworth, CA (US)

(73) Assignee: NOBLE HOUSE HOME FURNISHINGS, LLC, Chatsworth, CA (US)

( * ) Notice: Subject to any disclaimer, the term of this patent is extended or adjusted under 35 U.S.C. 154(b) by 4 days.

(21) Appl. No.: 16/265,088

(22) Filed: Feb. 1, 2019

Related U.S. Application Data

(63) Continuation-in-part of application No. 16/157,614, filed on Oct. 11, 2018, now abandoned.

(60) Provisional application No. 62/571,141, filed on Oct. 11, 2017.

(51) Int. Cl.

| | |
|---|---|
| ***A47C 4/02*** | (2006.01) |
| ***B65B 5/10*** | (2006.01) |
| ***B65B 5/08*** | (2006.01) |
| ***A47C 15/00*** | (2006.01) |

(52) U.S. Cl.
CPC ..... *A47C 4/02* (2013.01); *A47C 15/002* (2013.01); *B65B 5/08* (2013.01); *B65B 5/10* (2013.01)

(58) Field of Classification Search
CPC ..... A47C 4/02; A47C 15/002; B65B 5/08; B65B 5/10
USPC ..... 297/440.1
See application file for complete search history.

(56) References Cited

U.S. PATENT DOCUMENTS

| | | | | | |
|---|---|---|---|---|---|
| 2,418,731 | A * | 4/1947 | Seitz | A47C 4/021 | 297/152 |
| 2,660,228 | A * | 11/1953 | Reinhold | A47C 4/028 | 297/440.1 |
| 4,077,517 | A * | 3/1978 | Hilemn | A47C 4/02 | 206/577 |
| 6,056,121 | A * | 5/2000 | Olson | B65D 5/5059 | 206/326 |
| 6,267,446 | B1 * | 7/2001 | Wieland | A47C 4/021 | 297/188.08 |
| 6,804,938 | B2 * | 10/2004 | Levin | A47C 31/11 | 53/397 |
| 8,322,792 | B2 * | 12/2012 | Chen | A47C 17/045 | 297/440.1 |
| 2007/0095711 | A1 * | 5/2007 | Thompson | B65D 81/03 | 206/522 |
| 2010/0244536 | A1 * | 9/2010 | Chen | A47C 4/028 | 297/440.15 |
| 2017/0305631 | A1 * | 10/2017 | Lewis | B65D 65/02 | |
| 2019/0191882 | A1 * | 6/2019 | Coleman | A47C 4/028 | |

* cited by examiner

*Primary Examiner* — Milton Nelson, Jr.
(74) *Attorney, Agent, or Firm* — Colin P. Abrahams

(57) ABSTRACT

A furniture item comprises various components for assembly thereof. The furniture items include a substantially flat seat portion, a substantially flat back portion, connectors for securing the flat seat portion to the flat back portion, and a plurality of legs for attachment to the seat portion. Cushions are provided and may be configured to form barriers for use adjacent the seat portion and the back portion when packed in a container. Additionally, compressed and sealed cushions may also be provided to form barriers for use adjacent the seat portion and back portion when packed in a container.

6 Claims, 16 Drawing Sheets

FURNITURE CONSTRUCTION AND PACKING METHOD

CROSS-REFERENCE TO RELATED APPLICATIONS

This application is a continuation in part application of U.S. patent application Ser. No. 16/157,614 filed Oct. 11, 2018, which claims the benefit of U.S. Provisional Patent Application No. 62/571,141 filed Oct. 11, 2017, the contents of which are incorporated by reference herein in their entirety.

FIELD AND BACKGROUND OF THE INVENTION

This invention relates to furniture construction and a method for packing furniture, as well as other items. The invention relates to packing methodologies for products which may be bulky, as well as for streamlining the packaging, and enables the products to potentially occupy a smaller volume when packed.

The invention also relates to the packaging of products, such as furniture, wherein the product is modular or composed of components or segments which may be packed as such and assembled by a user or purchaser. In many instances, bulky and large furniture products are packed in multiple containers, and the present invention facilitates packaging of the various components into a fewer number, or even a single, container.

SUMMARY OF THE INVENTION

According to one aspect of the invention, there is provided a furniture item having components for assembly thereof, the furniture item components comprising: a substantially flat seat portion; a substantially flat back portion; connectors for securing the flat seat portion to the flat back portion; a plurality of legs for attachment to the seat portion; cushions configured to form barriers for use adjacent the seat portion and the back portion when packed in a container; and compressed and sealed cushions to form barriers for use adjacent the seat portion and back portion when packed in a container.

There is also preferably provided a container for sequentially and compactly receiving the seat portion, back portion, connectors, legs, cushions and compressed cushions, the cushions and compressed cushions being received within the container in positions for protecting adjacent components from damage. In one embodiment, the cushions and compressed cushions are arranged within the container so that all contents of the container are relatively tightly packed together to reduce or eliminate movement between them. Further, at least one of the cushions and compressed cushions may be placed in the container against a side wall, a base or a top of the container.

The furniture item may further comprise connecting hardware utilized for assembling components, and such connecting hardware may be stored within a hardware box, the hardware box being packed within the container.

In one embodiment, the furniture item comprises a first seat portion, a second seat portion, a first back portion and a second back portion, wherein the first seat portion and the second seat portion are connected to each other at corresponding side edges on the first seat portion and second seat portion, the first back portion is connected to the first seat portion, and the second back portion is connected to the second seat portion. Further, the first seat portion and first back portion may be connected to each other to form a lounger and the second seat portion and the second back portion are connected to each other to form a loveseat. Additionally, there may be at least one side arm.

In one embodiment of the invention, the furniture item comprises a first side arm connected to the lounger and a second side arm connected to the loveseat. Further, at least one of the legs may comprise a leg portion and a flat connector portion, the flat connector portion being connectable to one of the components. Preferably, guide markings may be indicated on the components to facilitate assembly and construction of the components.

In accordance with a further aspect of the invention, there is provided a method for packing in a container a furniture item comprised of discrete components when unassembled, the method comprising: placing leg components of the furniture item in bubble pack at the base of the container; placing connector hardware in the container over or between the legs components; placing a first substantially flat seat portion over the legs components; placing a first arm rest into the container, the armrest being located over the flat seat portion; placing a first compressed cushion over the first flat seat portion and first arm rest; placing a second substantially flat seat portion over the compressed cushion; placing a second compressed cushion over the second flat seat portion; placing cushions between the packed components and sidewalls of the container; and placing a first and second seat back over the second compressed cushion.

Preferably, the components are packed within a single container. Further, the container may be selected from standard shipping size containers available and used for multiple shipping purposes. In one embodiment, the components are packed within the container so that all of the components together substantially fill the container to reduce or eliminate movement of components they are in during storage and transportation.

Preferably, the cushions are selectively located and placed within the container to protect adjacent components from potential damage from external forces or from relative movement in the container between such components, and the components may be packed in a sequential manner so that unpacking of the components at least partially corresponds to its position in the assembly and construction sequence of the furniture item.

The invention thus provides a method and system of packaging which may be useful for the storage and transportation of furniture products such as, as an example only, sectional sofas. Many sectional sofas, due to their size and dimensions, are typically packaged in multiple boxes or containers for shipping through parcel shipping services, such as FedEx or UPS, or are otherwise shipped through a freight service. Because of the requirement for multiple boxes or containers, the shipping of such large items may well be expensive, and the customer may receive different parts of the product in separate shipments. The present invention is therefore directed towards a packing system and method which may have particular application for the storage and transportation of furniture products such as a sectional sofa or a chaise lounge, typically bulky items requiring storage in multiple containers. The invention facilitates the packaging of all components of these furniture types into a single box. Further, the invention is also for the specific structure and configuration of furniture items, which have been manufactured for more efficient storage and transportation.

In one form, a container with the packaged product therein may be shipped in a single FedEx 165 inch box, with the consequence that the cost for shipping such a large product may be significantly cut or reduced.

The invention therefore addresses current customer behavior buying trends, which has shifted towards a more convenient and time-saving model. Therefore, the present invention is directed towards a "one step buy" option, which allows the customer to have all of the components of a specific product, such as a furniture item, delivered in a single carton. In certain circumstances, this may include accessories such as a side coffee table, which may be included in the carton, depending upon the available space. With appropriate directions and steps provided, the customer would then assemble the entire set, and the time taken for doing so may vary depending upon the expertise level of the customer. Typically, for an average customer, it may take about 1.5 hours to assemble an entire set, and the assembly of such products may complete or meet the living room or study room needs of the buyer.

Moreover, upon completion of the assembly, the configuration and structure of the assembled pieces may allow an element of flexibility whereby several pieces maybe joined together to form a combination furniture item, or one or more of such pieces maybe separately utilized as a stand-alone item, either adjacent other pieces in the set, or in a different area or room.

The ability to construct, store and transport components for an item of furniture has several beneficial consequences, including production efficiency and quality management, management of item costs and packaging costs, as well as better warehouse space efficiency.

Mass production is also better facilitated. To achieve this, there should preferably be minimal complexity and a reduced number of steps for workers on the production floor. When an item requires complexity at production, time labor expenses are increased and manufacturing costs would be impacted. Further, more skilled labor may be required, making for higher labor costs. The present invention has an objective of simplifying the production process, and improving the packaging process, to address this situation, and this may preferably be achieved by utilizing relatively conventional production steps and procedures.

The packaging procedure and configuration of the present invention may further assist with quality management, both at the factory level and at post-production facilities. The packaging process may incorporate safety features and any issues may be more easily detected in accordance with the present invention.

Packaging costs may, as mentioned, be reduced, sometimes significantly. For example, a traditional sofa set may be packed into 2 to 3 cartons. In the present invention a single carton or container may be used, and the product material as well as its design have been maximized for efficiency. Cushion padding which is part of the final product may to a certain extent be used as part of the protective padding in the packaging process, thereby reducing packaging costs, improving environmental responsibility by reduction or elimination of materials such as Styrofoam, and saving space in the container. The actual carton size and carton costs may be reduced, partly as a result of reduced Styrofoam being used. A single instead of multiple cartons may also be of sufficient size for packing all of the relevant parts and components.

With the product being packed in a single carton, container shipping and container space maximization may be much more efficient and attainable, and container load ability improved, thereby contributing to the cost of all freight per piece being reduced. At the same time, since the entire set, such as a sofa set, is packed in one carton compared to the traditional two or three or even more that may otherwise be required, warehouse staffing requirements may be reduced and efficiencies improved in this area as well.

Another potential advantage of a single carton packaging system is that the courier or delivery services are less likely to misplace or incorrectly deliver containers, again saving time and cost, and also contributing to better customer satisfaction and positive reviews.

One example of a sofa which may be constructed for assembly and disassembly in accordance with the invention can be seen in FIGS. 19 and 20 of the drawings. A similar item of furniture may also be seen in FIG. 33, and may include a coffee table as part of the package, depending on space availability.

As illustrated in FIG. 34, all or some of the seat cushions or chaise cushions may be vacuum packed. Disassembly or knockdown is constructed into the device, including at the arms and backrests. After the seat cushions have been vacuum packed, they may be used as a cushioning or barrier material to protect other parts of the furniture device, thus saving costs. Preferably, all of the components, discussed below, should pack into a 275 psi carton box, with minimal packaging materials, but nevertheless in a manner which very ably is capable of protecting the contents from damage or breakage. The inclusion of the coffee table as part of the package may depend upon certain factors, importantly including weight limitations. If the inclusion of such a coffee table may seriously impact the volume occupied by the total package, or place it in a bracket which makes transportation costs unacceptably high, the coffee table may be omitted. Generally, where the product is packed into a single carton and compliant to FedEx 165 inch packing materials, the total weight must preferably fall within the 68 kg limit.

As shown in FIG. 34, the sofa may include a side pocket as an added feature. Further, in place of packaging materials which may serve as a protective barrier, there may alternatively be used soft cushions, which may also need to be vacuum packed, but which can be utilized by the customer on the item of furniture. This has the effect of actually turning protective packing material into useful accessories which may add to the value and appearance of the product, and vice versa.

In a preferred form of the invention, the underside wooden frame must be configured and designed so as to be made with the seat base or the arm. The legs must be capable of knockdown and shaved off. Where the product is a chaise lounge, the width thereof may need to be slightly decreased, such as about 1.5 inches from what may be considered a conventional size, in order to create space for the seat cushions.

According to one aspect of the invention, there is provided a method of packing a large item in a single container, the large item being comprised of components or segments at least some of which are constructed so as to reduce volume packaging size by being configured so as to register with other components or segments, and wherein selected components or segments of themselves configured so as to provide a barrier or interface for preventing or reducing damage.

According to a further aspect of the invention, there is provided an item of furniture comprising a plurality of components or segments for assembly, wherein at least some of the components or segments have been configured so as to constitute a packing barrier or protection, and where at least some of the components have been sized and shaped so as to correspond with each other. Preferably, the item of furniture is so packaged in a single carton or container.

DETAILED DESCRIPTION OF THE INVENTION

Figure 1:
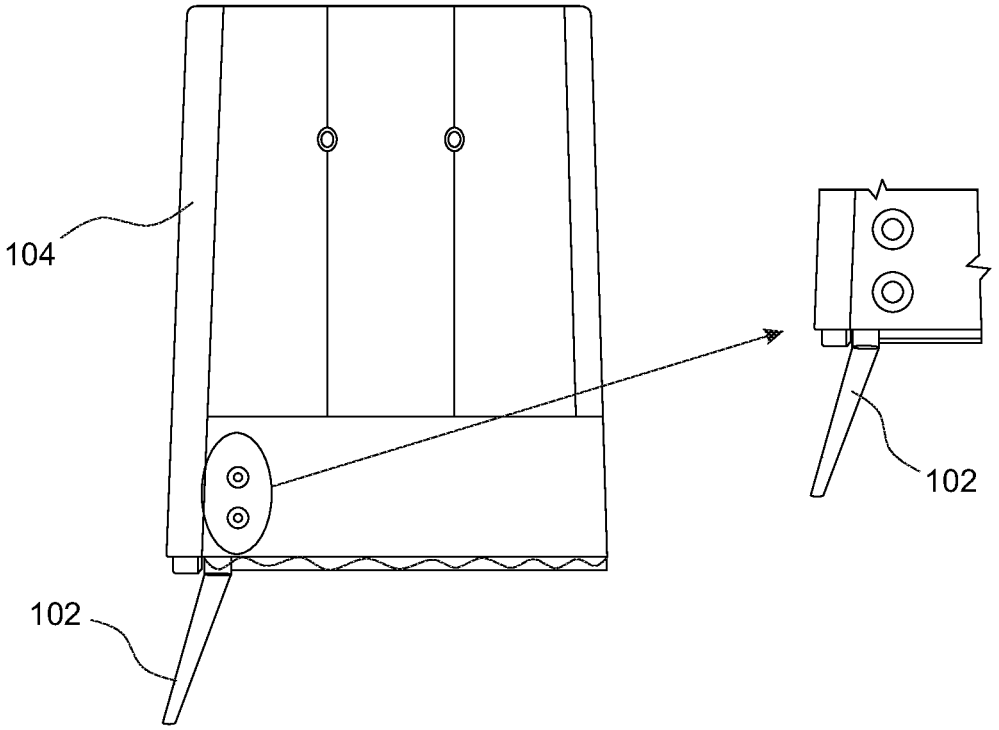
FIG. 1 shows a lounger back and wooden legs, including a detail, of an item of furniture in accordance with the present invention.

Reference is now made to the accompanying drawings which show various aspects of the invention. In the drawings, FIGS. 1 to 20 show assembly of a specific item of furniture in accordance with the invention, while FIGS. 21 to 33 illustrate the packing methodology by means of which the individual components are prepared and boxed so as to take advantage of optimal spacing and packing requirements.

Figure 21:
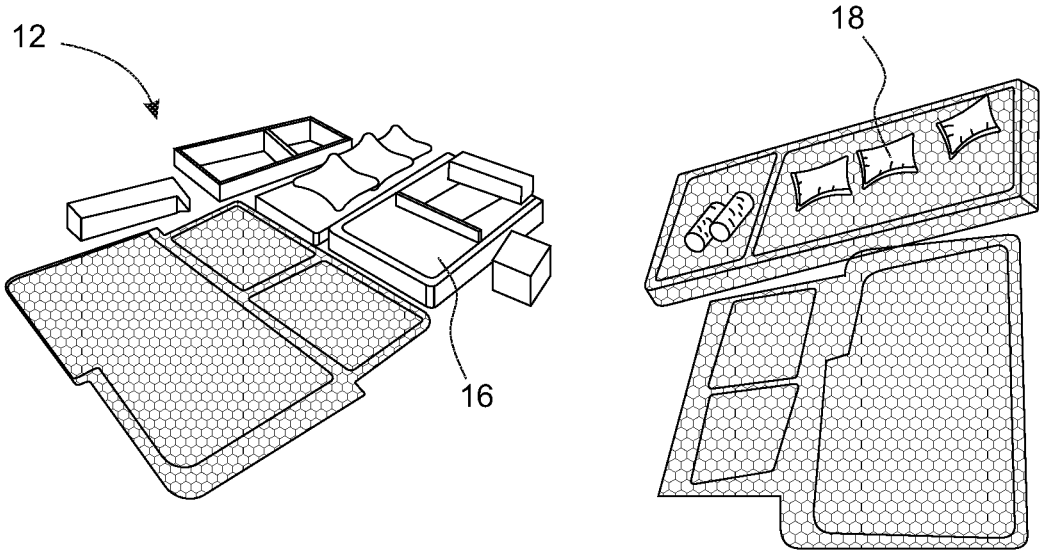
FIG. 21 illustrates parts and components of a furniture item for packaging within a container.

Reference is now made to FIGS. 21 to 30 which show one method in accordance with the invention for the compact packaging system. FIG. 21 of the drawings illustrates all of the parts and components 12 of a sectional sofa 14, which have been prepared for packaging within a single container. Where necessary, some pre-packing of components into interior boxes 16 have been made, so that certain parts, such as small hardware, can be packed and easily found later during unpacking. Seat cushions 18 for the sofa 14 are vacuum packed or otherwise wrapped so as to provide some protection for the actual product which will ultimately be used by the consumer. Furthermore, the various legs which will support the remainder of the sofa will preferably be pre-wrapped, such as with PVC wraps, in order to prevent or reduce damage, including scratches, chipping or breakages.

Figure 22:
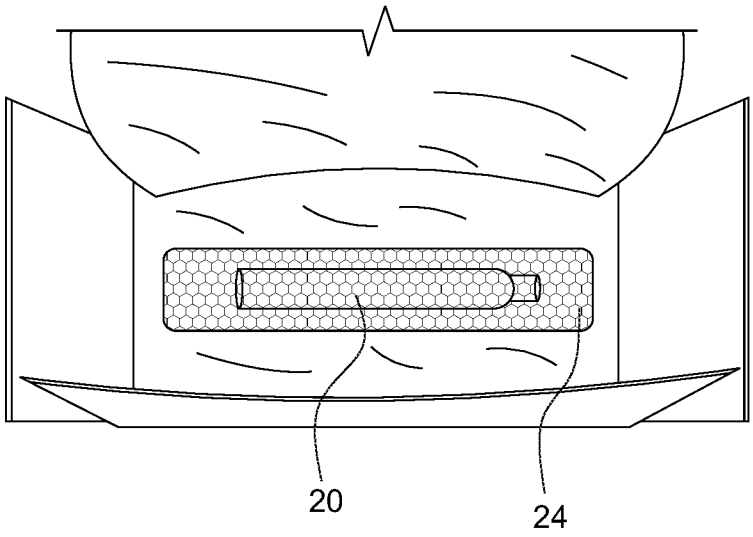
FIG. 22 illustrates packing all or some of the legs within the container.
Figure 23A:
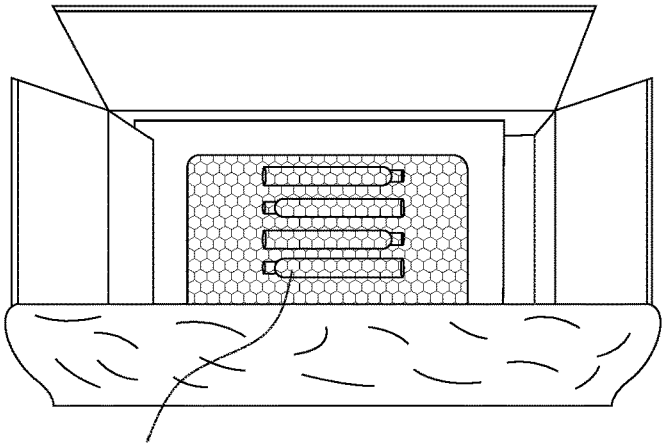
FIGS. 23A and 23B illustrate further packing of remaining or additional legs within the container.
Figure 23B:
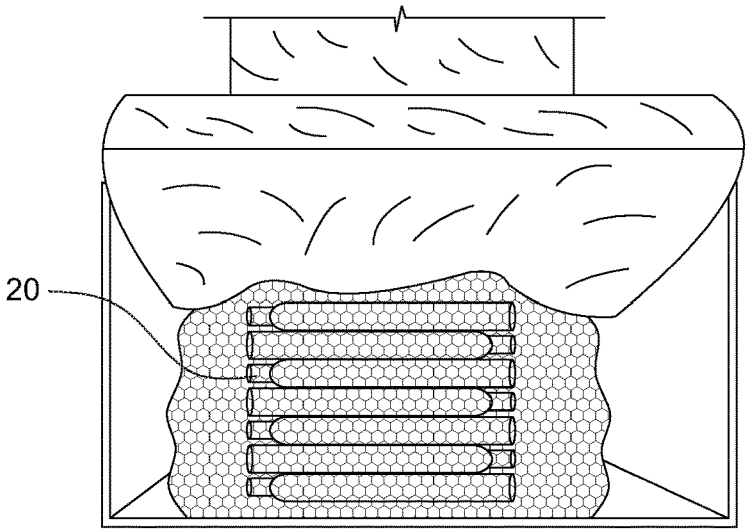
Figure 24:
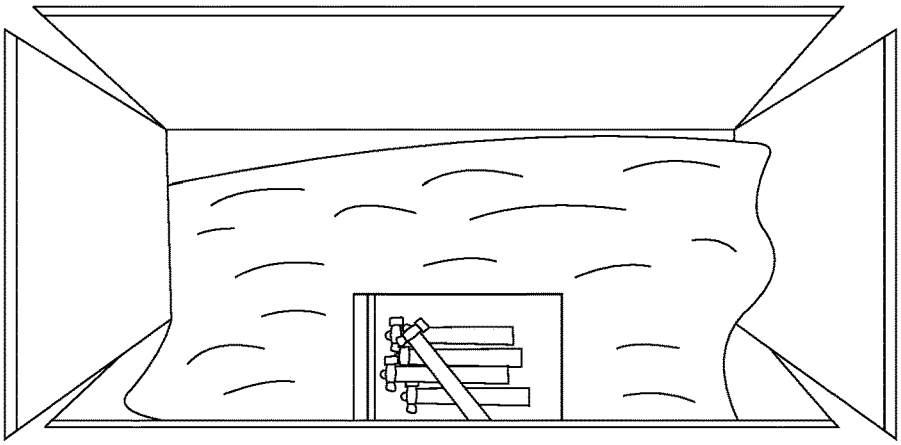
FIG. 24 shows the addition of certain hardware for assembly added to the container.
Figure 25:
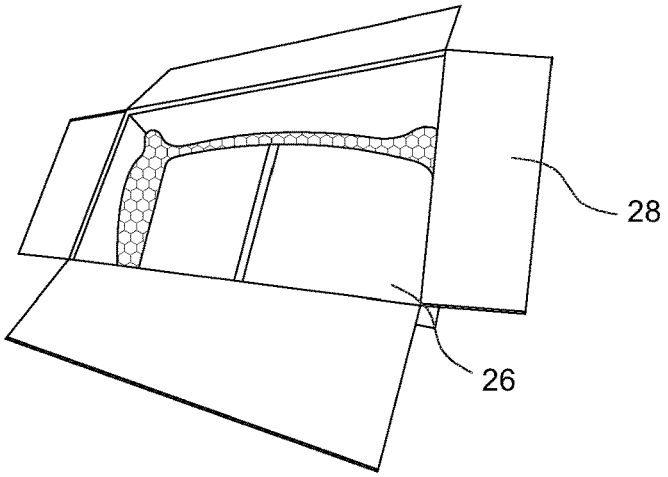
FIG. 25 shows the addition of the chaise lounge seat placed within the container.

FIGS. 22 to 24 illustrate the packaging of the legs 20. The legs 20 may be wrapped in bubble pack 22, and placed inside a smaller box 24 and wrapped with wrapping material. Certain hardware is placed in the same box 24, as shown in FIG. 24, and the box 24 is closed and appropriately sealed. FIG. 25 illustrates the placement of the chaise lounge seat 26 within the box 28. This is separated from the backrest, and placed in the box face down. The seat cushion 18, which is relatively thick, will also serve as packaging padding for the main base frame.

Figure 26:
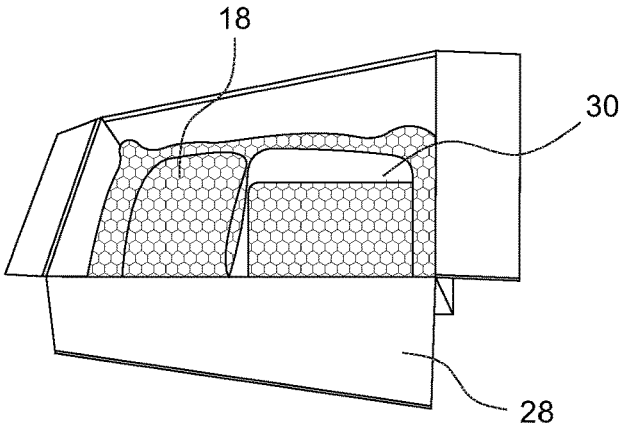
FIG. 26 illustrates the placement of the arm rest into the container.
Figure 27:
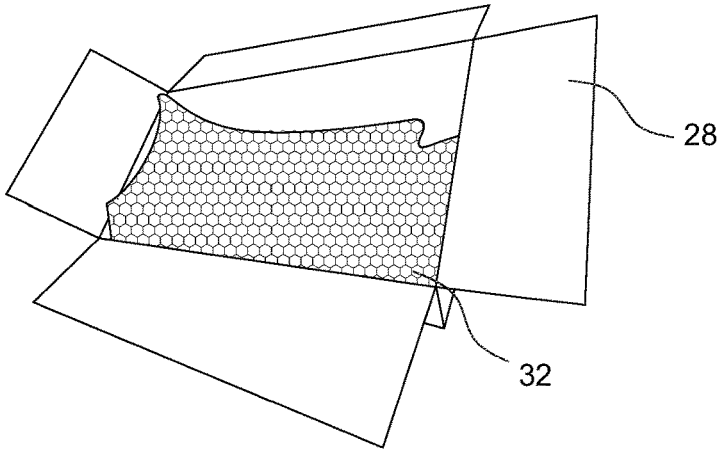
FIG. 27 illustrates the placement of the packed seat cushion within the container.

FIG. 26 illustrates the placement of the arm rest 30 into the carton box 28. The arm rest 30 may be packed into the housing of the seat cushion 18. The arm rests 30 of both the chaise lounge and the opposing end of the sofa are packed so as to lie flat on top of the chaise lounge seat, that has previously been packed. This is followed by the packaging of the chaise lounge vacuum packed seat cushion 32 on the seat of the chaise lounge, as shown in FIG. 27. These cushions 32 are placed in the box 28 in a manner so as to lie flat on top of the packaging described with respect to FIGS. 25 and 26.

Figure 28:
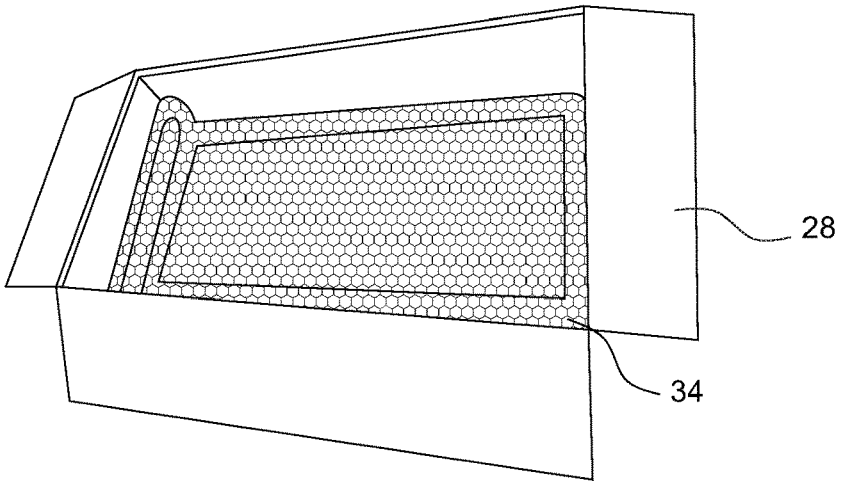
FIG. 28 illustrates the placement of the sofa seat within the container.
Figure 29:
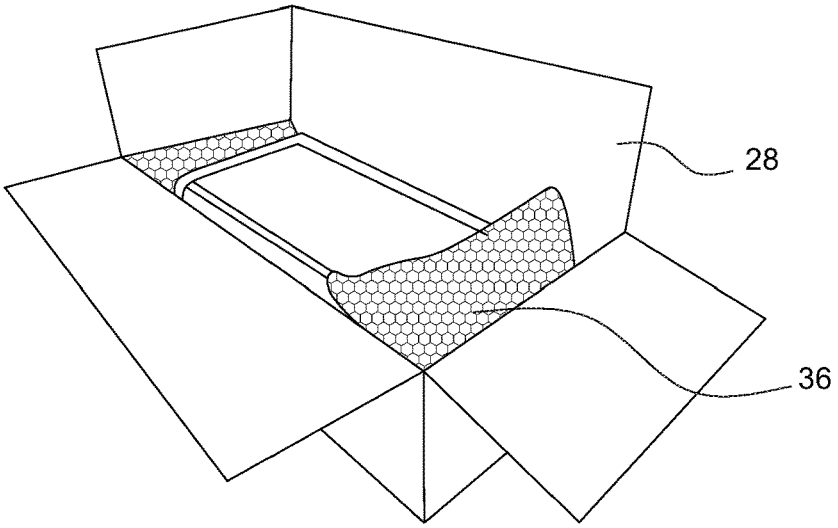
FIG. 29 illustrates placement of the vacuum packed seat cushions within the container.
Figure 30:
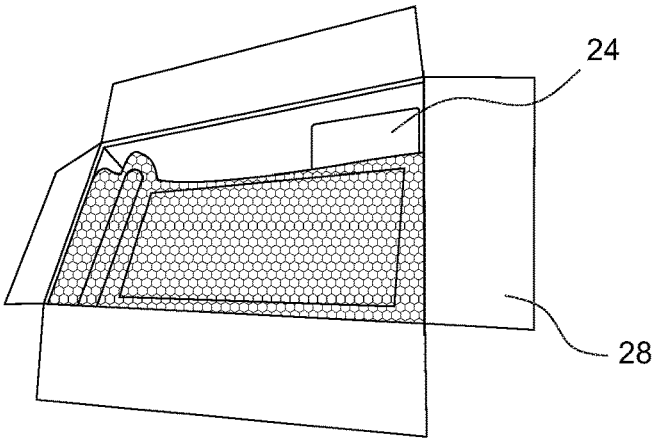
FIG. 30 illustrates the placement of a separate leg box which is inserted into the container.

In FIG. 28, the sofa seat 34 is placed into the box 28 on top of the sealed cushion 18, and separated from the sofa back. In FIG. 29, the vacuum packed seat cushions 36 are packed. These pillows 36 may be oval-shaped or have another shape, and are inserted into the box 28 between the sofa seat and one short edge of the box. In FIG. 30, the previously sealed separate leg box 24 is inserted into the larger box 28 between the sofa seat and one long end of the box.

Figure 31:
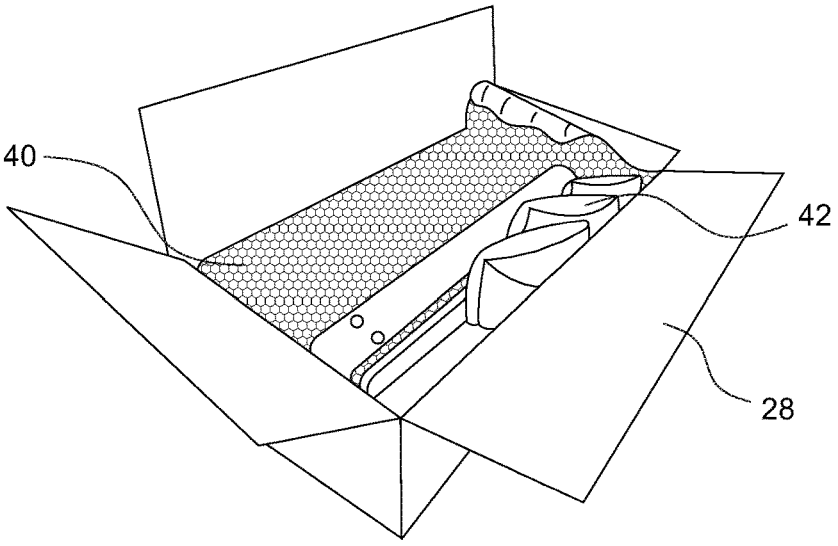
FIG. 31 of the drawings illustrates the placement of the sofa seat back within the container.
Figure 32:
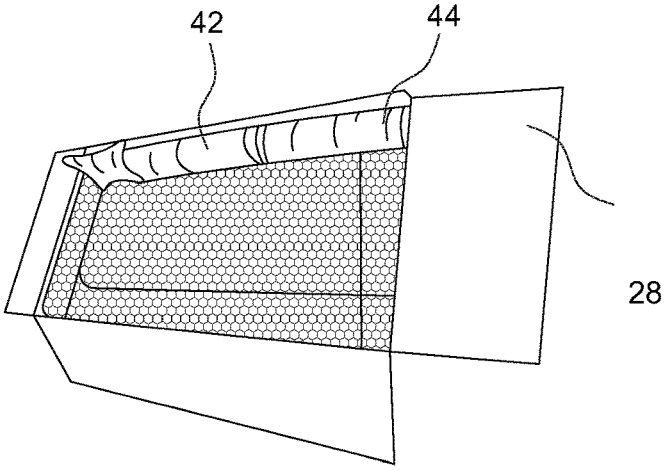
FIG. 32 illustrates the placement of cushions for use with the furniture within the container.
Figure 33:
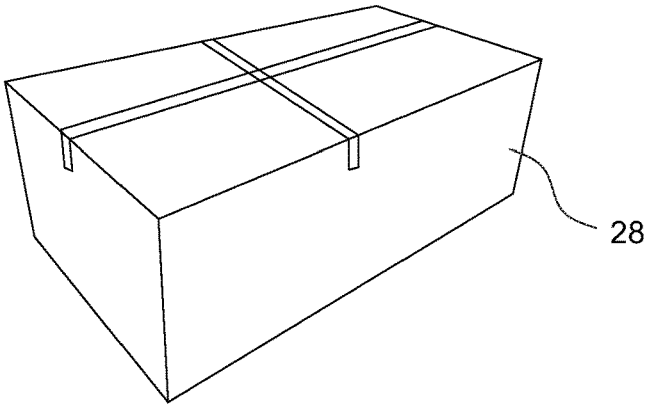
FIG. 33 illustrates the container when closed and sealed, the container comprising a standard size regularly used in the shipment of products.
Figure 34:
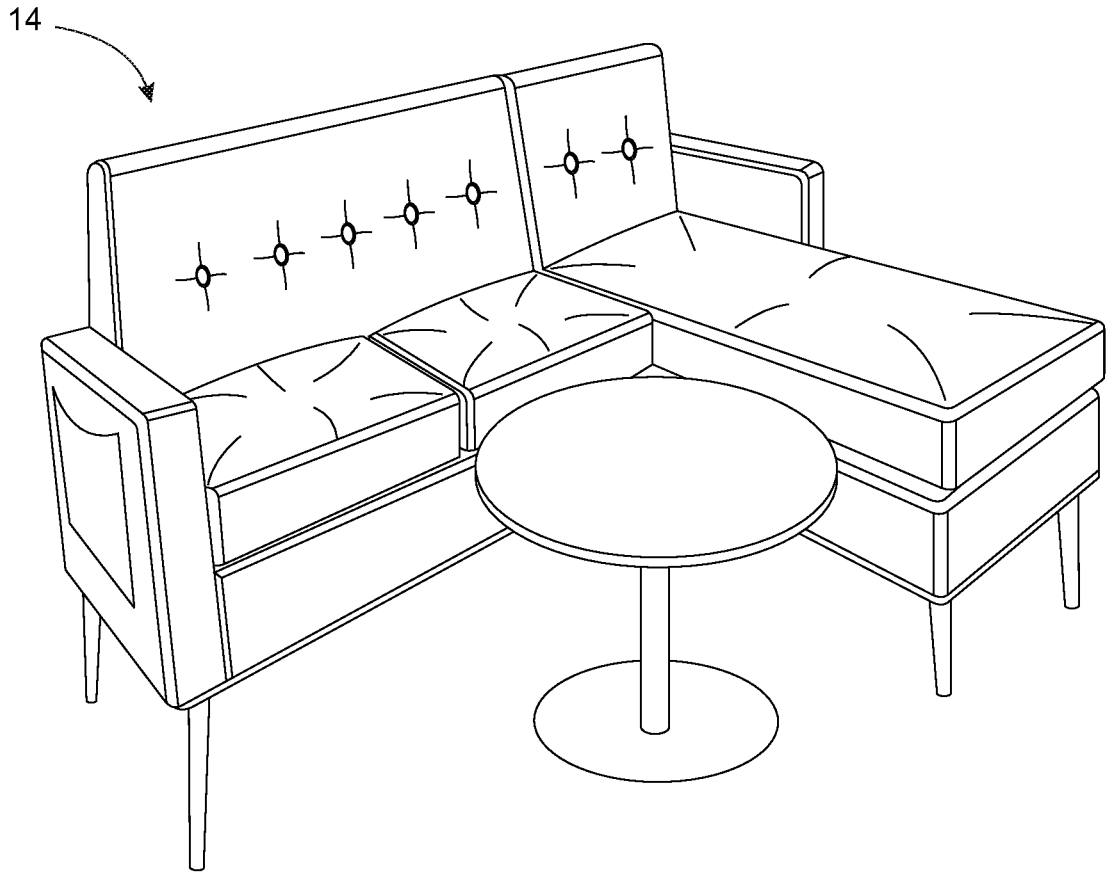
FIG. 34 illustrates a further view in accordance with an embodiment of the invention illustrating the assembled item of furniture constructed and assembled in accordance with the present invention.

In FIG. 31, the sofa seat back 40, detached from the sofa seat 34, is placed into the box 28 on top of the sofa seat 34 previously packed within the box 28. Thereafter, the square pillows 42 are placed in between the sofa seat back and the long edge of the box 28. These cushions 42 on the side also serve as cushion padding. In FIG. 32, the complete placement of all the cushions is illustrated. A second oval pillow 44 is placed into the box between the sofa seat back and the long edge of the box 28, sitting next to the square pillows 42. At this point, all of the topmost items will be substantially flush with the upper box edges. In FIG. 33, the carton boxed is finally closed and sealed. The size of the box is one known in the industry as a FedEx 165 inch standard, selected for its ready availability, and appropriate for transportation by delivery companies.

Once delivered and ready for unpacking and assembly, the components can be removed from the box in a methodical and orderly way, facilitating such assembly. Some of these steps are illustrated in FIGS. 1 to 20 of the accompanying drawings.

Figure 2:
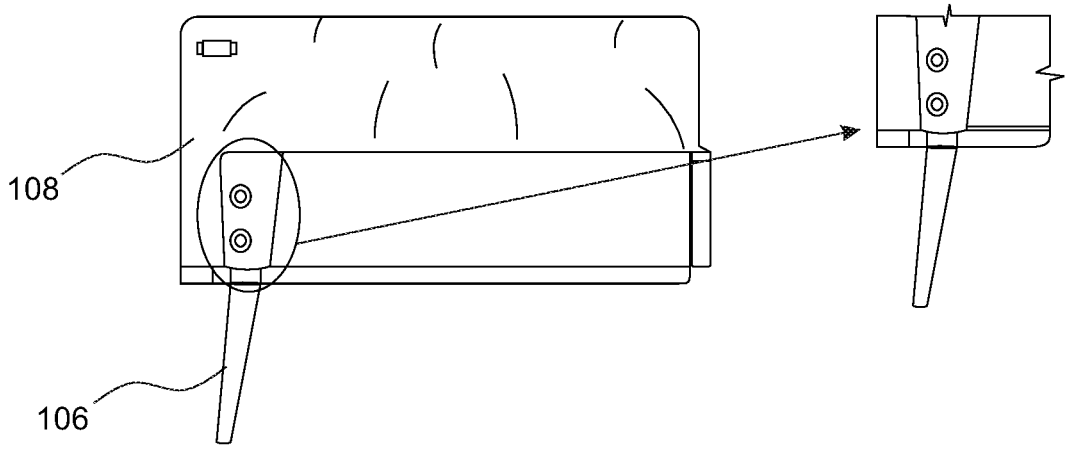
FIG. 2 shows wooden legs and a lounger back, including a detail, of an item of furniture in accordance with the present invention.

In FIG. 1, wooden legs 102 are fastened to the lounger back 104, and it should be noted that the markings for the mounting positions on the lounger and wooden legs 102 should match in order to assure proper alignment and orientation. The legs 102 are attached using bolts, washers and spring washers, and the tightening of the bolts may be effected by an Allen key or some other tool. In FIG. 2, wooden legs 106 are assembled or fastened to the lounger armrests 108 and, once more, the marking on the respective pieces of hardware should be matched to ensure proper assembly. Once more, bolts, washers and spring washers are used, and may be tightened by an Allen key. For the convenience of the customer or person assembling, the lounger armrests and love seat armrest may be distinguished from each other in that the bottom of the lounger armrest has a painted wooden frame.

Figure 3:
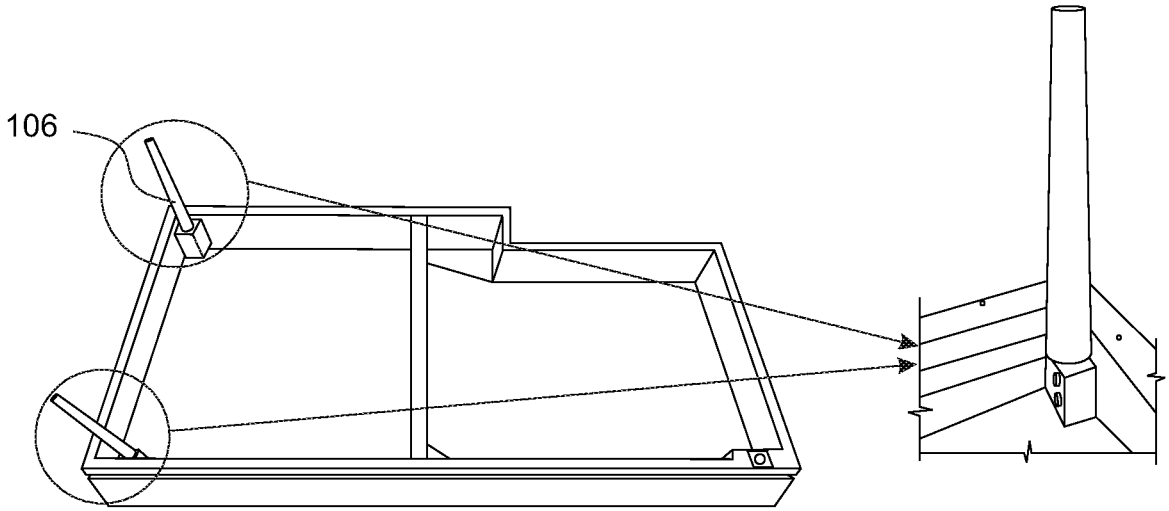
FIG. 3 shows a bottom perspective view showing wooden legs and lounger with markings, including a detail.

In FIG. 3, there is a further illustration to emphasize the fact that the wooden legs 106 and the lounger received both have appropriate markings for orientation and mounting positions, which should be matched.

Figure 4:
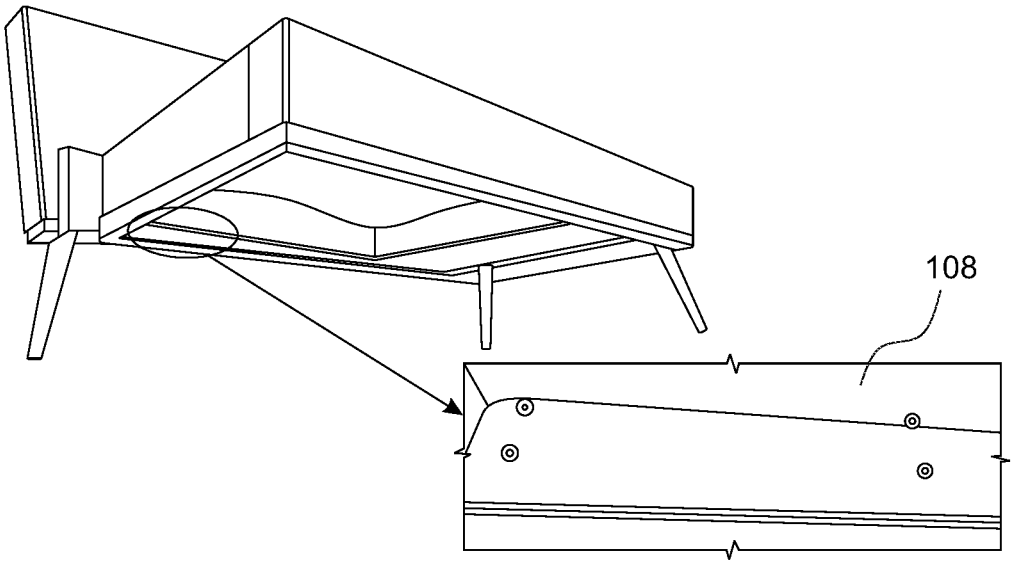
FIG. 4 shows an arm rest and attachment mechanism, including a detail, of the item of furniture in accordance with the present invention.
Figure 5:
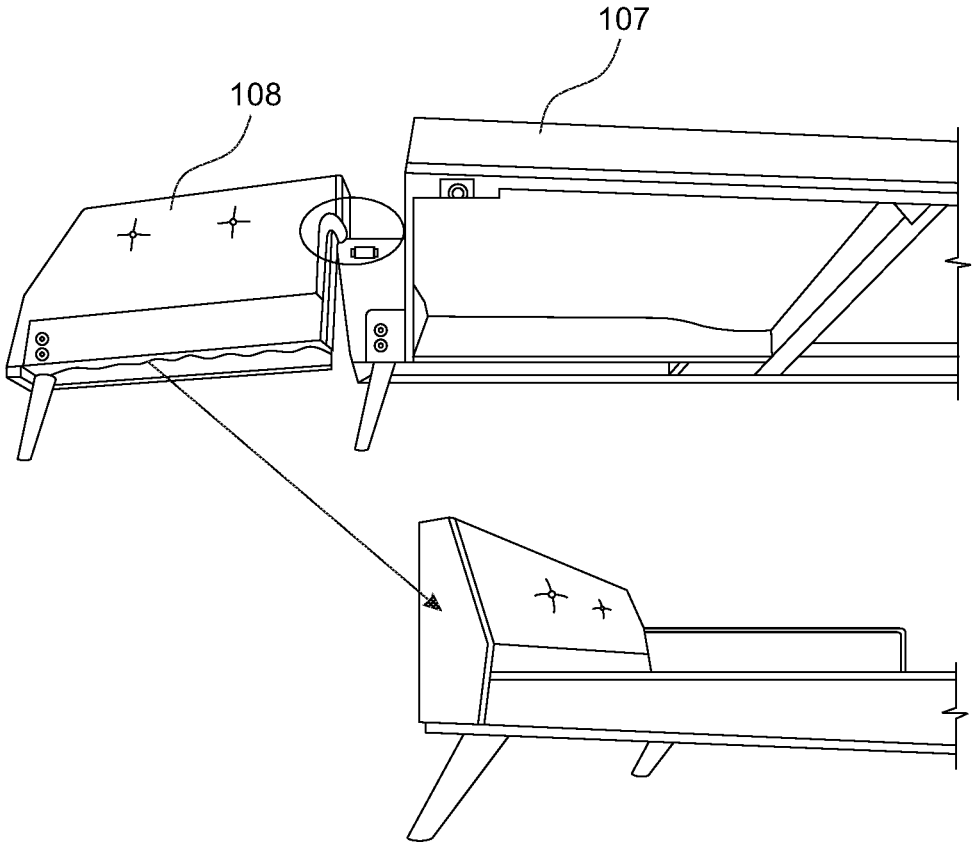
FIG. 5 shows a back rest of a lounger and loveseat, including a detail assembled view, in accordance with the present invention.

In FIG. 4, it is illustrated that the armrest 108 is placed in the "open arm housing area" of the loveseat and precisely affixed to the corresponding position. Four screws are utilized to both position and affix the armrest 108 to the loveseat. In FIG. 5, the backrest 107 of the lounger is affixed to the loveseat, and attention should be paid to the "buckle and hook" clasps, which are marked by the circle in this figure. This is a slip and slide clasp. Upon completion of the buckle and hook step, appropriate tightening utilizing the provided bolts is effected to ensure a secure connection.

Figure 6:
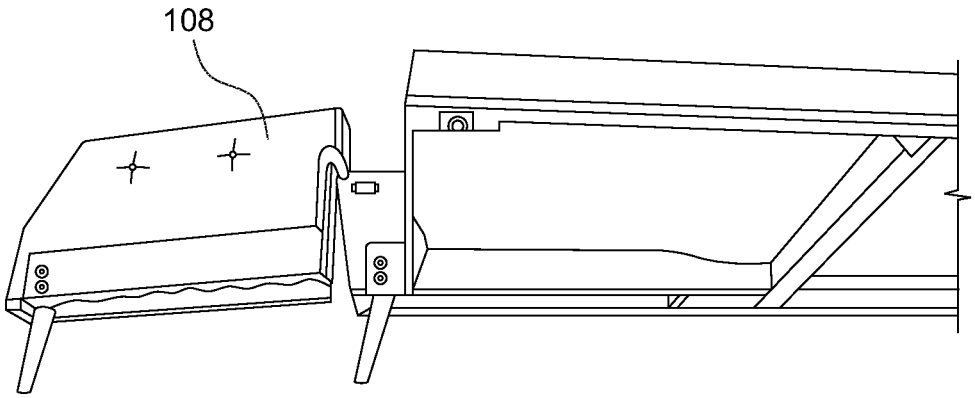
FIG. 6 illustrates armrest and loveseat attachment, including use of screws.
Figure 7:
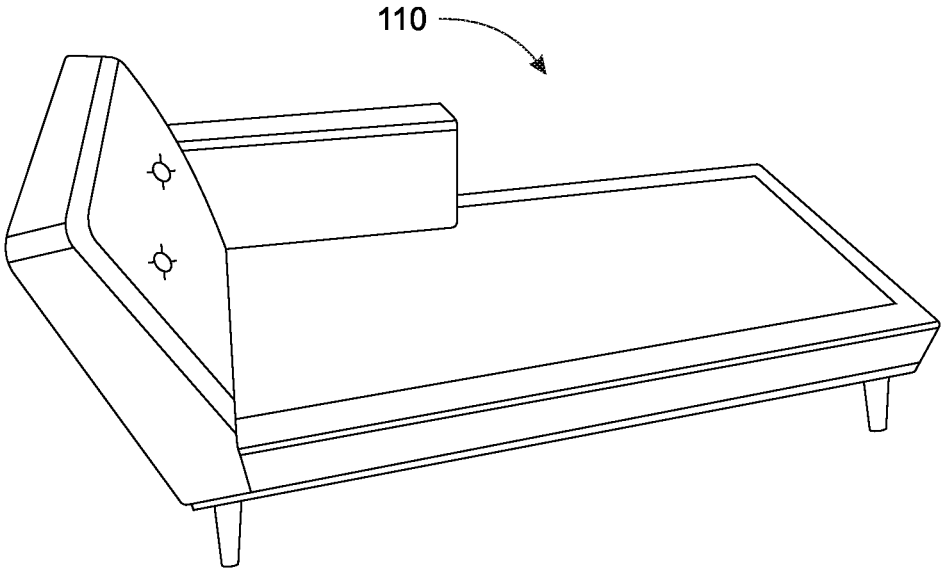
FIG. 7 illustrates an item of furniture with components as previously illustrated in their connected positions, according to the invention.

FIG. 6 illustrates the utilization of all four screws to affix and tighten the armrests 108 to the loveseat apron area. FIG. 7 illustrates the parts which have been connected at this point of the assembly, which to a large extent has fastened the lounger components together to form the lounger 110.

Figure 8:
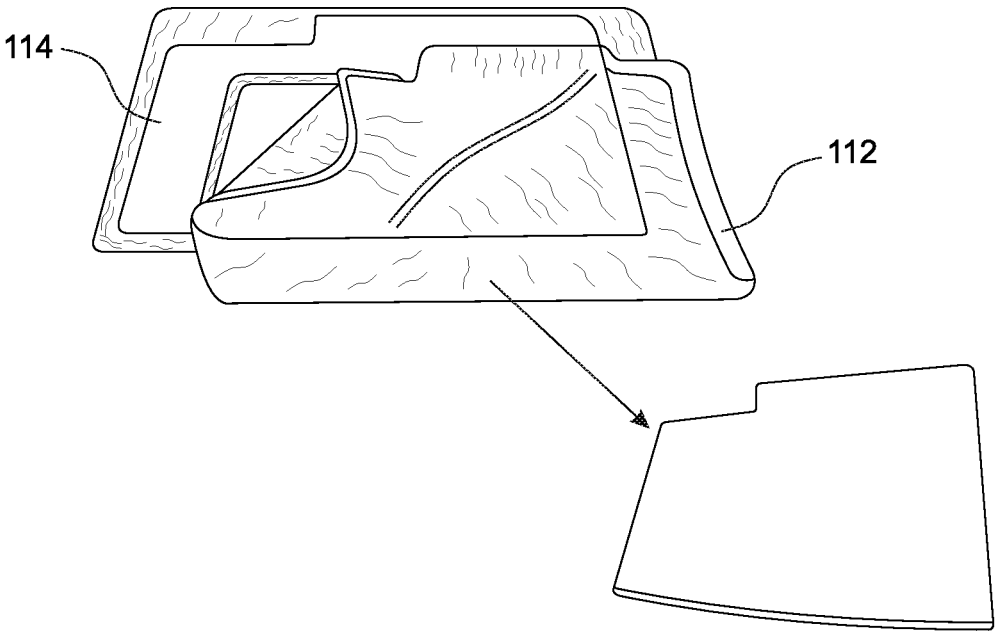
FIG. 8 illustrates cushion covers for use with the furniture of the present invention, including a detail.

Reference is now made to FIG. 8 of the drawings. The cushion covers 112 are shipped folded and loose. The customer assembling will at this point place the correct cushions with the corresponding correct cover and slip the cushion, which is still sealed, into the cushion cover. Thereafter, the user will move a pair of scissors into the cushion cover and cut open the PVC vacuum pack which contains the cushion. Of course, caution must be exercised at this step to ensure that neither the cushion or the cushion cover is inadvertently cut or damaged. The seat cushion is gently slipped out of the PVC bag, and slowly allowed to fill up with air, since it has been compressed for storage and transportation. The cushion cover 112 may then be closed by means of the provided zipper, and the cushion 114 may be plumped up and smacked a few times to draw air into the filled cushion. This process allows the cushion to expand from it compact state and return to its original shape. It should be noted that, before the cushion may in fact gain its fullest shape, a significant amount of time, such as up to 10 days, may be required.

Figure 9:
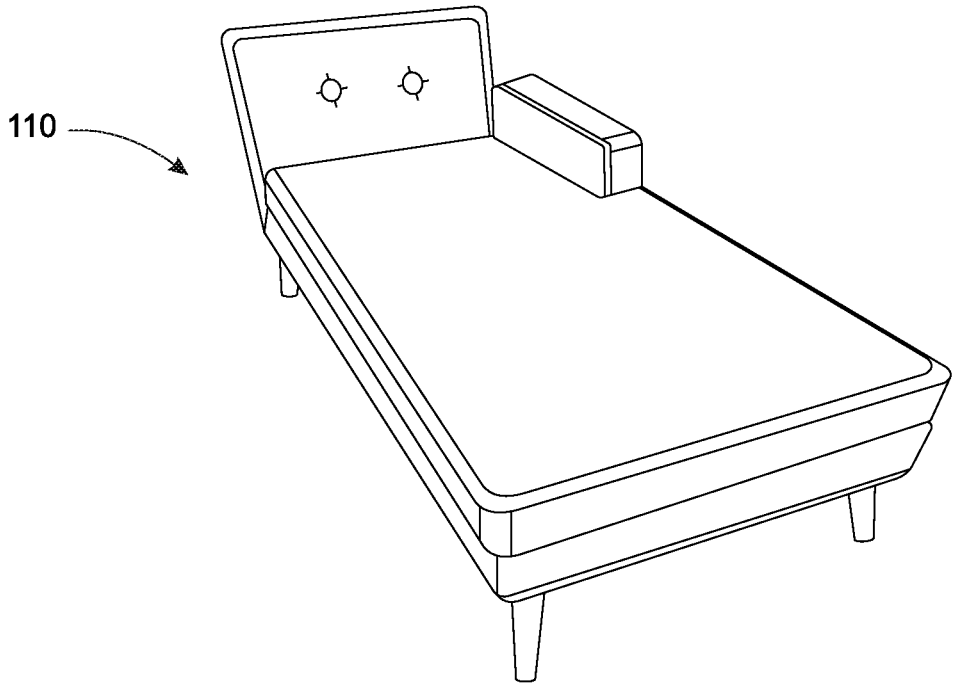
FIG. 9 illustrates a perspective view of a lounger with cushion mounted thereon, with components as previously illustrated.

In FIG. 9, the lounger 110 is shown, and the seat cushions prepared as previously described may be placed on the lounger and loveseat as illustrated or otherwise desired.

Figure 10:
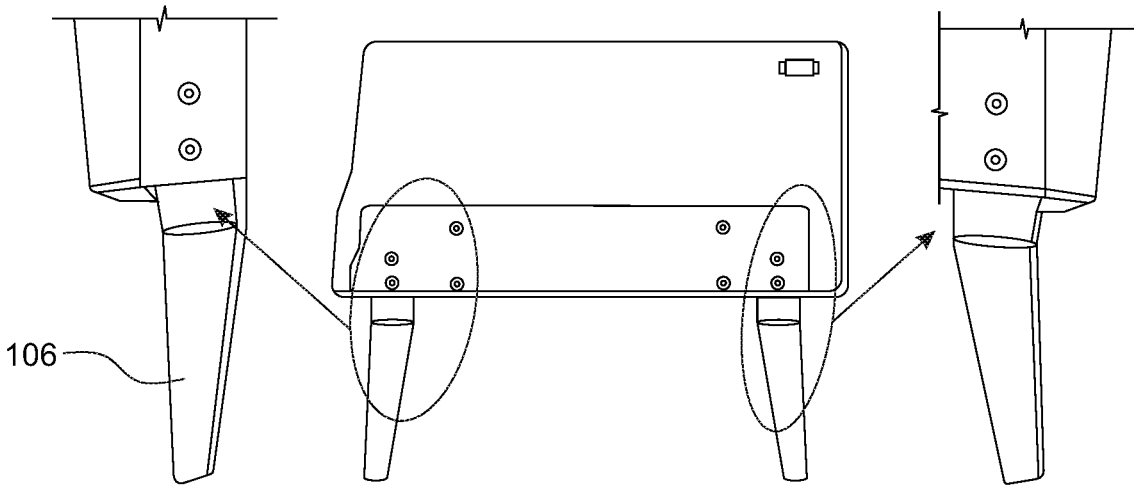
FIG. 10 illustrates wooden legs which are assembled onto a loveseat arm, including a detail, in accordance with the invention.

In FIG. 10, wooden legs 106 are assembled onto the loveseat arm, as illustrated, and, as described above, appropriate mounting positions on the respective components are provided to ensure correct assembly and orientation. The wooden legs 106 are fastened and tightened as previously described.

Figure 11:
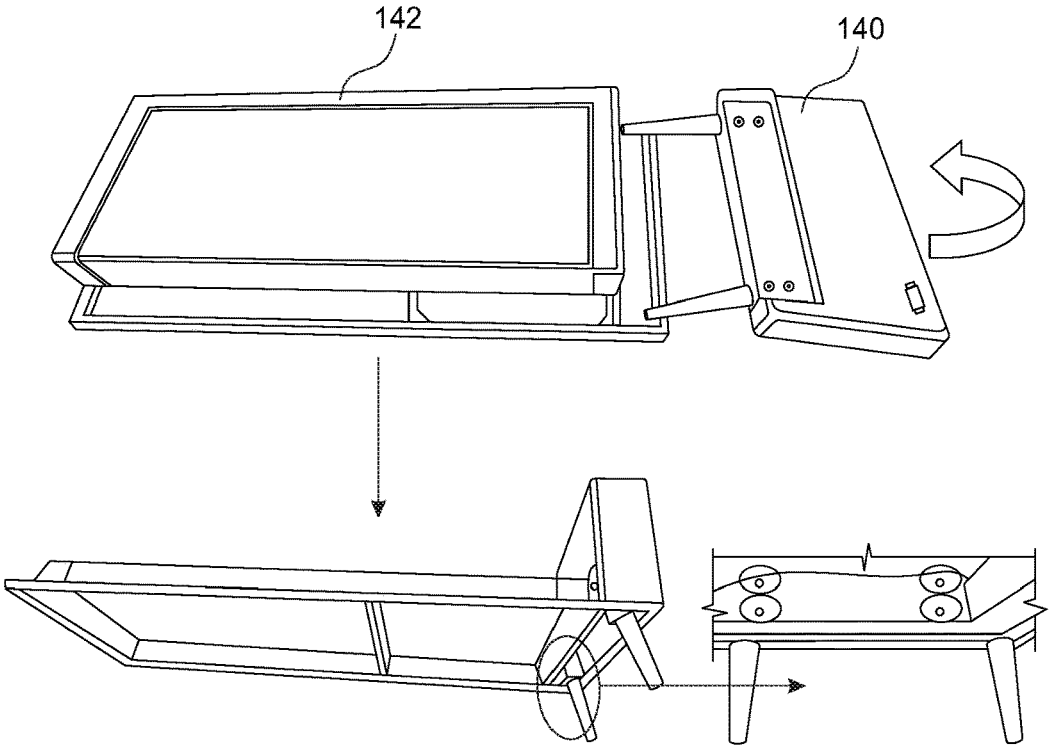
FIG. 11 illustrates the loveseat armrest mounted on the loveseat frame, including a detailed illustration.
Figure 12:
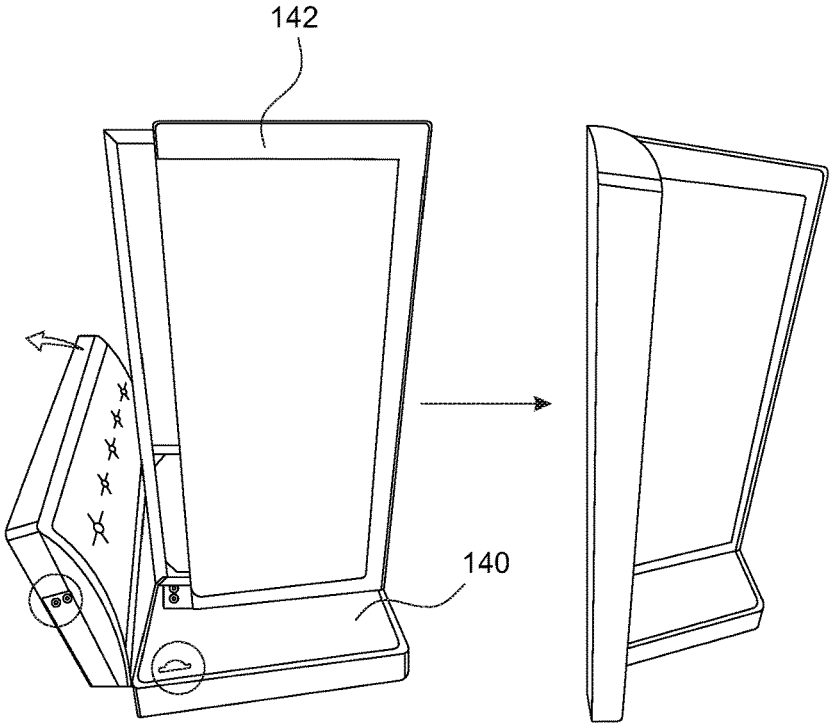
FIG. 12 illustrates mounting points, shown in circles, for connecting furniture components, including different perspectives.
Figure 13:
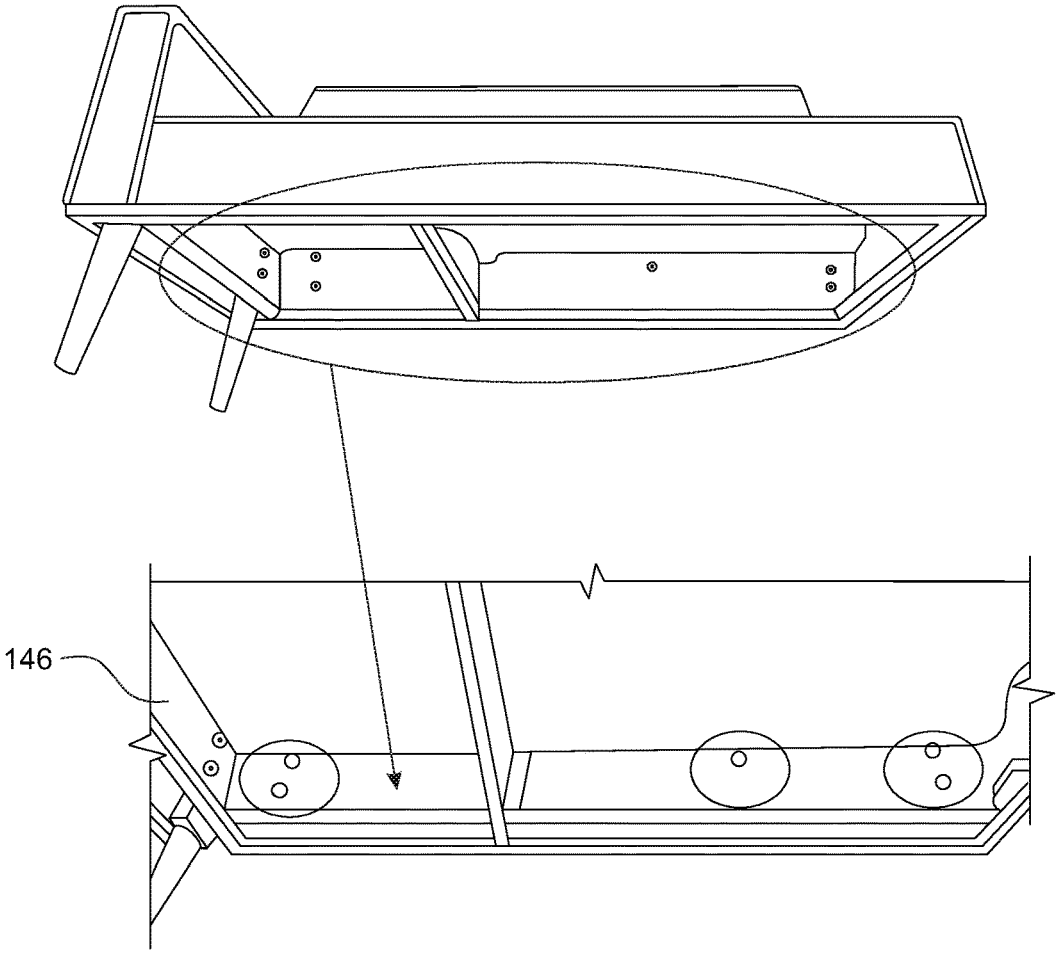
FIG. 13 illustrates, including a detail, the use of five screws for effecting the connection.

In FIG. 11, the loveseat armrest 140 is mounted to the loveseat frame 142. In the circle, and detail illustration, the two wooden legs are inserted in the paint frame, the armrest is turned up, and screws are used in the loveseat frame to secure and fix the armrest. In FIG. 12, with the loveseat armrest 140 mounted to the loveseat frame 142, and as highlighted by the circles, small inserts need to be fixed, in effecting the connection. As shown in FIG. 13, five screws 146 are mounted in the back of the chair to secure a tight connection.

Figure 14:
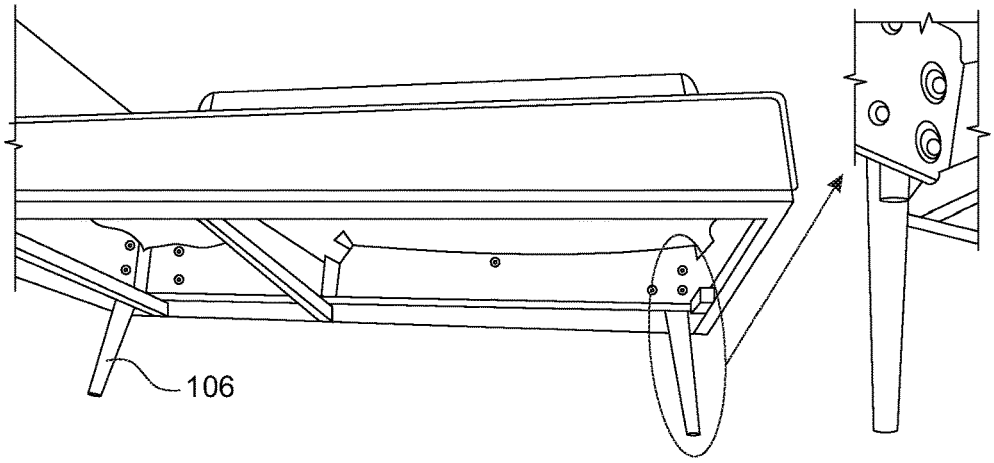
FIG. 14 shows mounting guides, including a detail, for placement in mounting positions, of various components of the invention.
Figure 15:
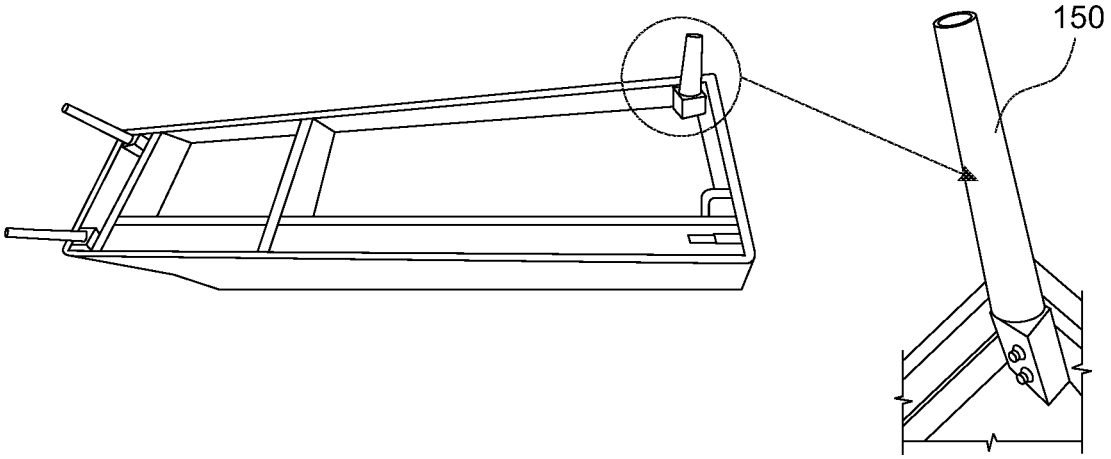
FIG. 15 shows installation of a wooden legs on a sofa, including a detail thereof.
Figure 16:
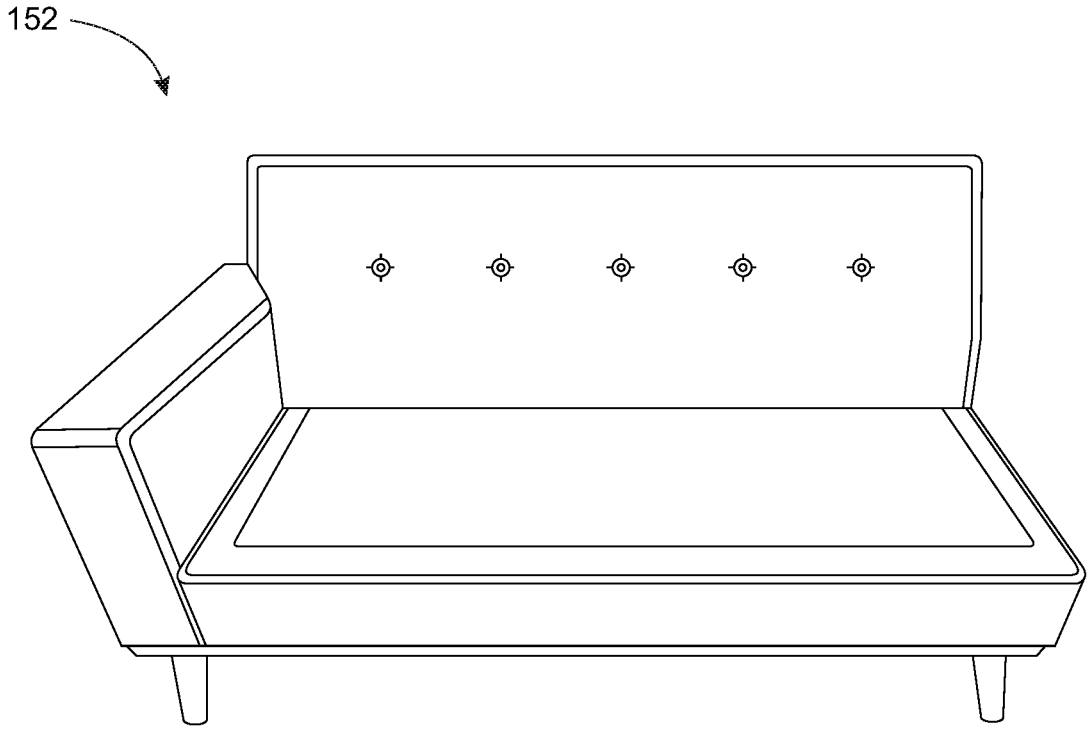
FIG. 16 illustrates a love seat constructed and shown in the fully installed and assembled condition.

As shown in FIG. 14, when assembling the wooden legs of the loveseat back, the letter on the mounting position should match the letter on the leg. Attachment by means of bolts etc. with an Allen key, as described, is effected. In FIG. 15, there is illustrated the step of installing the last of the wooden legs 150 on the sofa, and appropriate matching as described is provided to assist in proper assembly and orientation. FIG. 16 of the drawings shows the loveseat 152 in the fully installed and assembled condition.

Figure 17:
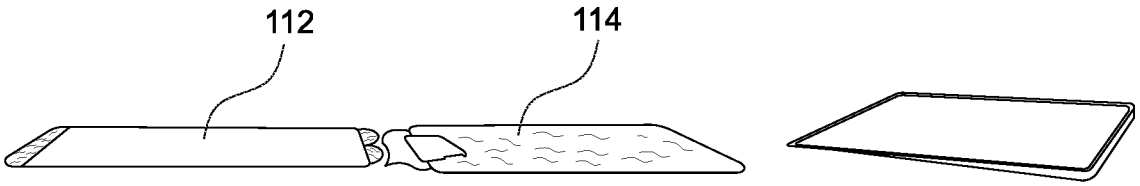
FIG. 17 shows sequential removal of a compressed air chair cushion, for use with a furniture item in accordance with the invention.
Figure 18:
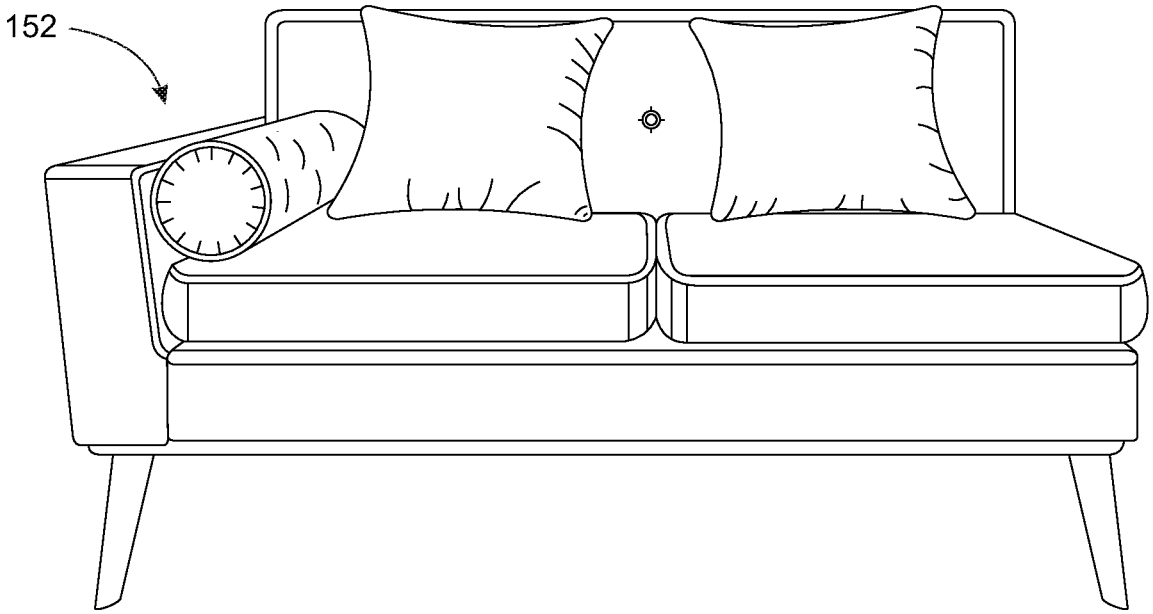
FIG. 18 is a front perspective view of a loveseat, including cushion covers and cushions, in accordance with the invention.

FIG. 17 illustrates once more the removal of the compressed chair cushion, which may be made of sponge, unwrapped from each packing, and set in its appropriate cushion case. It is sealed with the provided zipper, and the vacuum packing removed so that the cushion can rebound and eventually reach its full size. FIG. 18 is a front view of a loveseat 152 installed with the two cushion covers 112, as well as accessorized with cushions 114.

Figure 19:
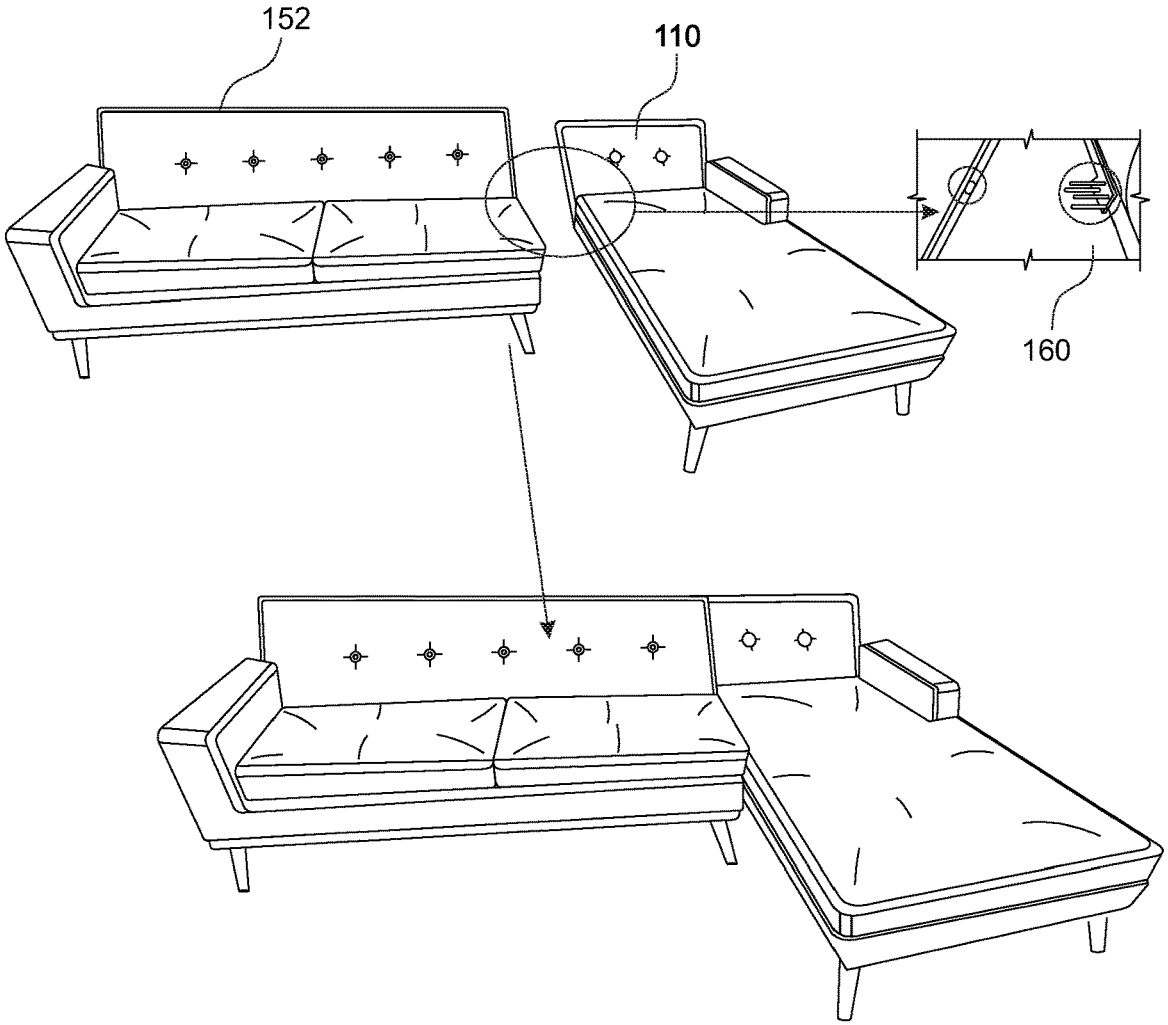
FIG. 19 shows sequential assembly and connection points of the loveseat and lounge, previously assembled, in accordance with the invention.
Figure 20:
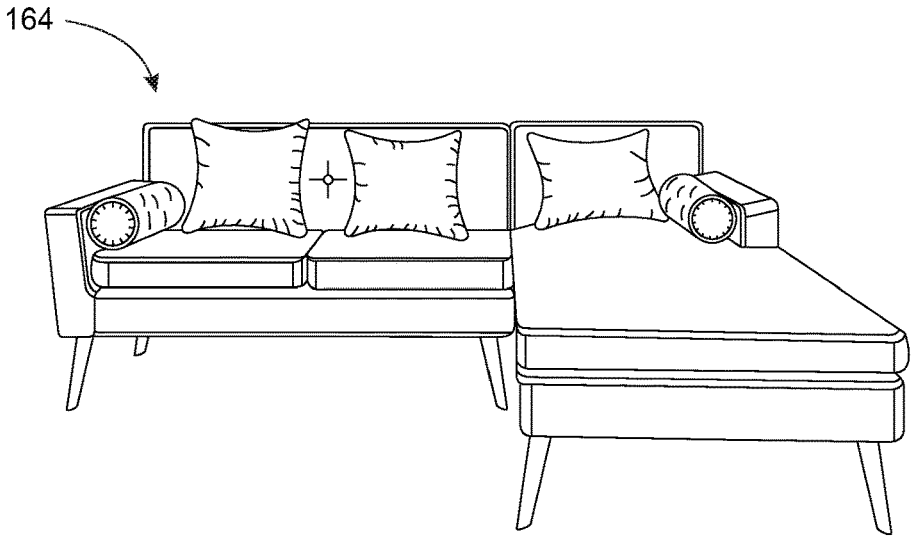
FIG. 20 illustrates the completed loveseat and lounge assembly of the furniture in accordance with the invention.

In FIG. 19, with the loveseat 152 and lounger 110 having been separately assembled, attachment of these two components can now be carried out. On the left of the loveseat 152 and on the right of the lounger 110 assembly rods and inserts 160 are provided, and when these two components are connected, the sofa set insulation and finish is complete. The completed assembly 164 is illustrated in FIG. 20 of the drawings. A review of this figure illustrates the significant number of components and size of the assembled product, but the construction of the components and its methodology for packing nevertheless enable it to fit within a single standard size container, having all of the benefits and advantages which result therefrom, as discussed above.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A method for packing in a container a furniture item comprised of discrete components when unassembled, the method comprising:

placing leg components of the furniture item in bubble pack at the base of the container;

placing connector hardware in the container over or between the leg components;

placing a first substantially flat seat portion over the leg components;

placing a first arm rest into the container, the armrest being located over the flat seat portion;

placing a first compressed cushion over the first flat seat portion and first arm rest;

placing a second substantially flat seat portion over the compressed cushion;

placing a second compressed cushion over the second flat seat portion;

placing cushions between the packed components and sidewalls of the container; and placing a first and second seat back over the second compressed cushion.

2. A method as claimed in claim 1, wherein the components are packed within a single container.

3. A method as claimed in claim 2 wherein the container is selected from standard shipping size containers available and used for multiple shipping purposes.

4. A method as claimed in claim 1 wherein the components are packed within the container so that all of the components together substantially fill the container to reduce or eliminate movement of the components during storage and transportation.

5. A method as claimed in claim 1 wherein the cushions are selectively located and placed within the container to protect adjacent components from potential damage from external forces or from relative movement in the container between such components.

6. A method as claimed in claim 1 wherein the components are packed in a sequential manner so that unpacking of the components at least partially corresponds to its position during assembly and construction sequence of the furniture item.

* * * * *